United States Patent [19]

Johnson

[11] 4,193,245

[45] Mar. 18, 1980

[54] DOOR FRAME CONSTRUCTION

[75] Inventor: Larry K. Johnson, Sterling, Ill.

[73] Assignee: Lawrence Brothers, Inc., Sterling, Ill.

[21] Appl. No.: 930,807

[22] Filed: Aug. 3, 1978

[51] Int. Cl.[2] ..... E04C 2/38

[52] U.S. Cl. ..... 52/656; 403/231; 52/455; 52/735

[58] Field of Search ..... 52/455–459, 52/656, 696, 735; 403/231, 242

[56] References Cited

U.S. PATENT DOCUMENTS

| | | | |
|---|---|---|---|
| 1,220,163 | 3/1917 | Anderson | 160/374 |
| 2,632,928 | 3/1953 | Kaufman | 52/455 |
| 4,021,988 | 5/1977 | Edeus et al. | 52/656 |

FOREIGN PATENT DOCUMENTS

| | | | |
|---|---|---|---|
| 1411743 | 8/1965 | France | 52/656 |
| 1407 | of 1906 | United Kingdom | 52/656 |
| 992227 | 5/1965 | United Kingdom . | |

*Primary Examiner*—James L. Bridgill, Jr.
*Attorney, Agent, or Firm*—Trexler, Wolters, Bushnell & Fosse, Ltd.

[57] ABSTRACT

There is disclosed a door frame construction, preferably of metal, which comprises cross channel members assembled perpendicularly with a pair of parallel upright channel members to form a rectangular frame. The respective channel members are held in assembled squared relation by a novel type of joint construction, which joint includes a pair of elongate slots formed in ones of the channel members which slots cooperating receive first detent members formed on the other of the channel members. The first detent members prevent disassembly of the joined channel member in a generally lateral direction. In addition, said slot also cooperates with second detent members received therein, which preclude relative pivotal movement between the assembled channel members and thereby serve to maintain the channel members in squared relation.

12 Claims, 5 Drawing Figures

DOOR FRAME CONSTRUCTION

BACKGROUND OF THE INVENTION

This invention relates in general to structural frames and in particular to a new and improved metal door frame construction for use in the assembly of large doors for industrial or agricultural buildings.

While the present invention is useful in the fabrication and assembly of frames for many purposes, the disclosure will be facilitated by addressing the specific problem of providing reliable and inexpensive door frames for relatively large sliding doors, of the type utilized with industrial or agricultural buildings such as barns, or the like. In such structures, on-site construction and assembly of the doors is generally desirable due to the advantages in shipping the doors in "knock down" form, rather than in the fully assembled mode. Once the door frame is assembled, corrugated metal siding or panels are attached to the frame.

The manufacturers of such doors and door hardware have recognized the existence of a number of problems as to weight, difficulty of assembly and reliability in service of such door frames. Initially, it will be appreciated that weight as well as overall size presents a problem to the assembler and installer, as such doors are generally in the range of eight feet-by-eight feet, or larger. Accordingly, there has been developed a need for a door frame that can be easily fabricated by the installer at the jobsight, with a minimum amount of handling, and without the use of a great number of separate fastener elements to maintain the frame elements in assembly. An example of one approach to this problem is found in U.S. Pat. No. 4,021,988, wherein upright channels and cross channels are interfitted to form a frame, and locked together by means of prepunched tongues which are bent or deformed inwardly to interlock with slots, to maintain the channel member in assembly. This particular type of joint or attachment means is intended to hold the end edges of the cross channel member in firm flush engagement with the web portion of the upright channels, thus insuring squaring of the assembled door frame components. Recognizing, however, the relatively light gauge metal utilized in this type of structure, the tongues may weaken or even break off in service, or while the door frame is being handled during installation. More specifically, the described prior art structure requires the inward bending of tongues on both sides of the upright channels to complete the assembly of the frame. Accordingly, the workmen must initially lay out the channel pieces and bend the tongues on one side and then flip over the entire, partially assembled, frame in order to bend in the tongues at the opposite side. As the structure is relatively large and heavy, this procedure places a considerable burden on the installer. But more to the point, this "flipping over" places considerable forces upon the partially assembled frame, which may cause the tongues initially bent over to loosen and the frame to go out of square before the assembly of the siding can be completed. These problems are particularly severe with door frames of the large size generally utilized for barn doors. Moreover, it will be appreciated, that in service or during movement to complete assembly, considerable moment is exerted by the long cross channels as compared to the relatively small opposing force exerted by the bent over tongue members. The resulting moment tends to pull the assembled door out of square. It will be appreciated that once these tongues are loosened, even slightly, the forces opposing relative pivotal movement of the cross pieces are greatly diminished.

Accordingly, it is a general object of this invention to provide a new and improved metal door frame construction which overcomes many of the problems encountered in prior art structures. A more specific object is to provide a metal door frame construction which is adapted both to lock the respective channel members in engagement and to prevent relative pivotal movement therebetween, so as to hold the assembled frame structure substantially in squared relation. Another object is to provide a metal door frame construction, in accordance with the foregoing objects which may be relatively easily assembled by a single workman, without requiring any flipping over or lifting of the structure until assembly is complete. Briefly, the foregoing objects, and others are achieved by a metal door frame construction according to the present invention which provides a novel joint for the interconnecting of the cross channels to the upright channel. In this regard, detent means are utilized to maintain initial assembly and prevent lateral displacement. Further, detent means are employed to prevent relative pivotal movement between the channel members. The respective detent means are, as will be explained more fully hereinafter, designed to provide a snap-fit type of joint, that can be easily achieved without special tools or the necessity of having to turn over the frame before attaching the siding.

Other objects, features and advantages of the invention will be more readily appreciated upon consideration of the following detailed description, together with the accompanying drawings.

DESCRIPTION OF THE ILLUSTRATED EMBODIMENT

Figure 2:
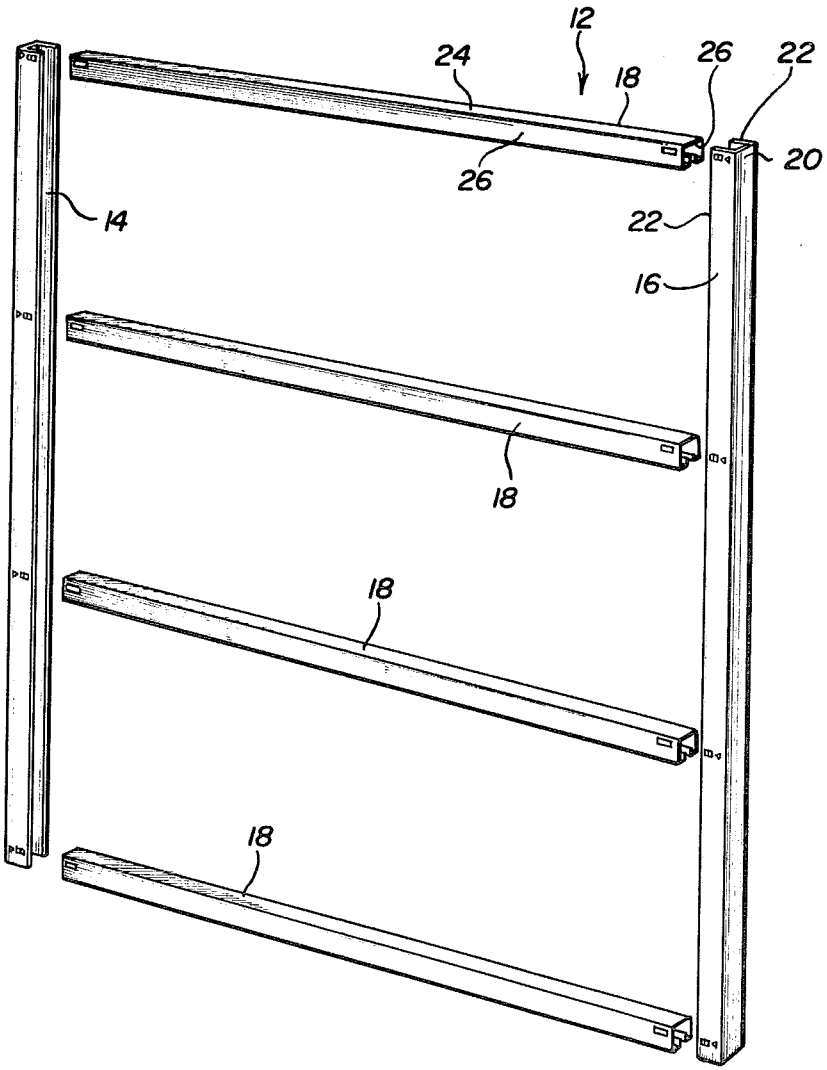
FIG. 2 is an exploded or disassembled perspective view of the door frame of FIG. 1.
Figure 1:
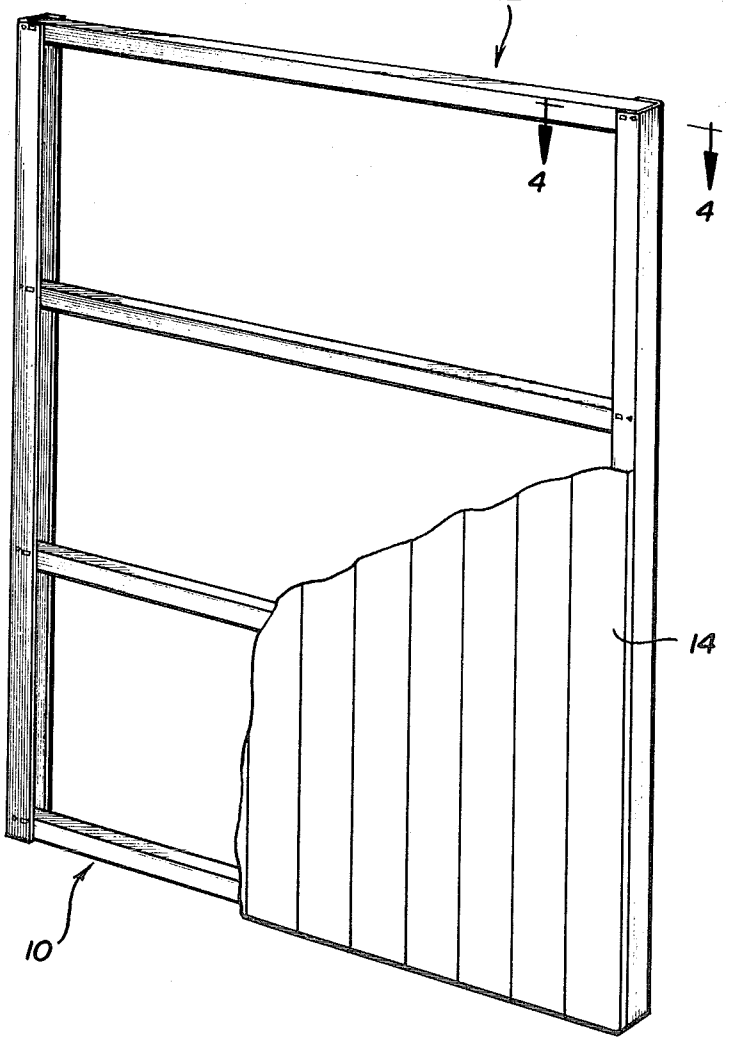
FIG. 1 is a perspective view of an assembled door with siding panels partially cut away to reveal the underlying door frame structure.

Referring now to the drawings and initially to FIGS. 1 and 2, there is illustrated an assembled sliding door 10, of the type commonly utilized in structures such as barns. Broadly speaking, the door 10 includes a frame, designated generally 12, to which is affixed one or more sections of siding 14. The present invention, as discussed above, is concerned with the frame 12, which is illustrated in FIG. 2 with the various component parts or members laid out for assembly.

With reference to FIG. 2, it will be seen that, the frame 12 comprises a pair of generally vertical or upright channel members 14 and 16, and a plurality of substantially identical horizontal, or cross channel members 18. In the illustrated embodiment, four such cross channel members 18, and two upright channel members 14 or 16 are illustrated, although in a particular door a lesser or greater number may be utilized, depending primarily upon the size of the door to be constructed.

Figure 3:
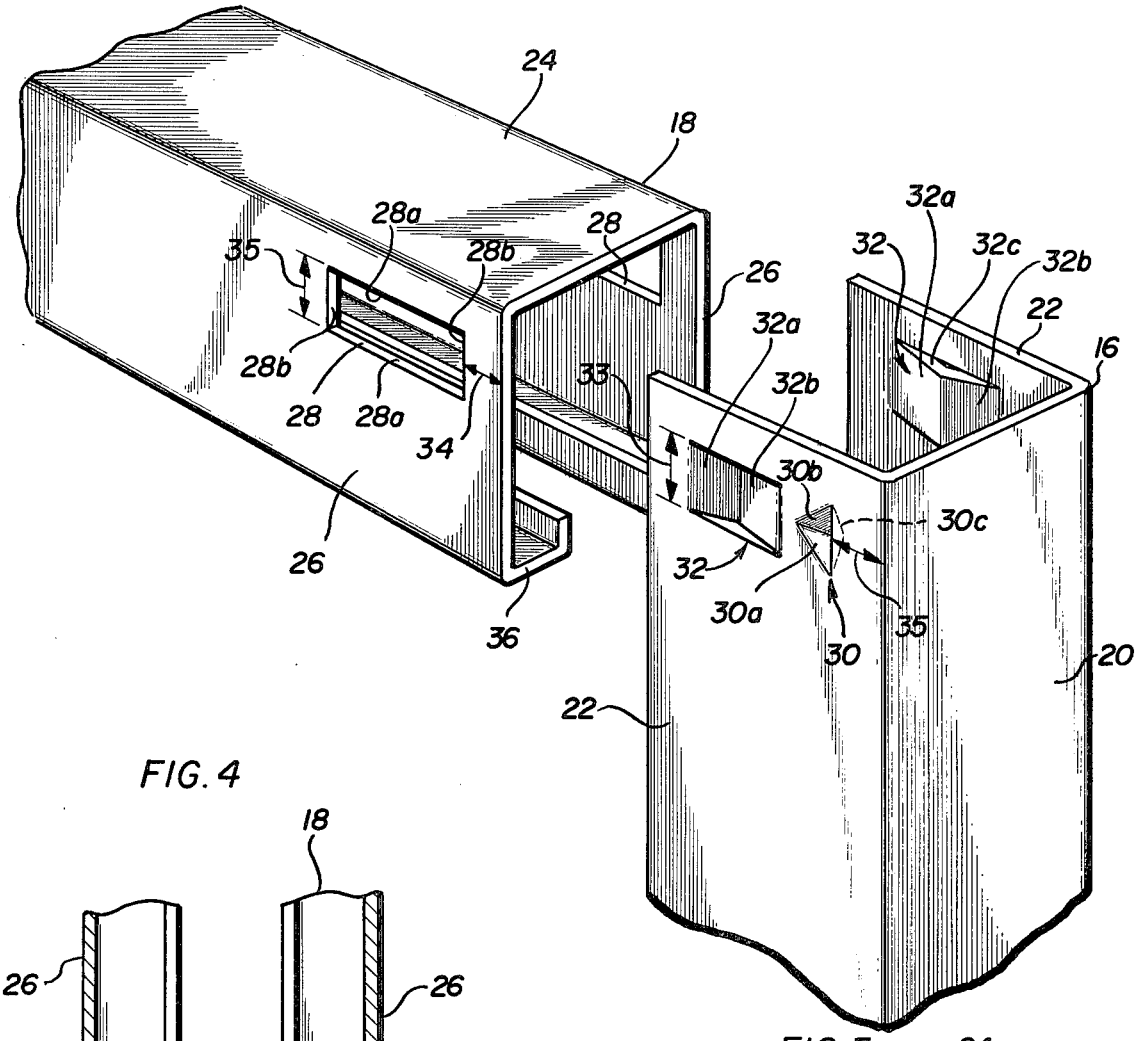
FIG. 3 is an enlarged cut away view of typical interlocking portions of the door frame of FIG. 2, illustrating features of the invention.

As can be seen in FIGS. 2 and 3, each of the upright channel members 14, 16 includes a web portion 20, with a pair of spaced apart parallel side flanges 22 extending from said web portion 20. Similarly, each cross channel member 18 includes a web portion 24 and a pair of depending spaced apart parallel side flanges 26. The width of the web portion 24 across the outer faces of the side flanges 26 is similar to the width of the upright channel 16 across the inner faces of their side flanges 22, whereby the end portions of the cross channel members can be interfitted within the upright channel members. Once interfitted, the novel joint structure of the present invention serves to maintain assembly and more importantly this is done while achieving a squared relation for the respective channel members, 14, 16 and 18.

Figure 4:
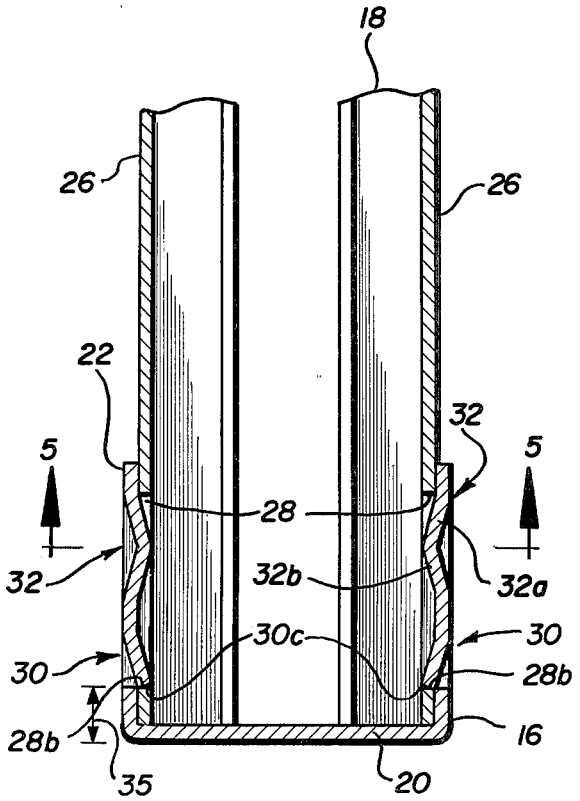
FIG. 4 is an enlarged partial sectional view taken generally along the line 4—4 of FIG. 1.
Figure 5:
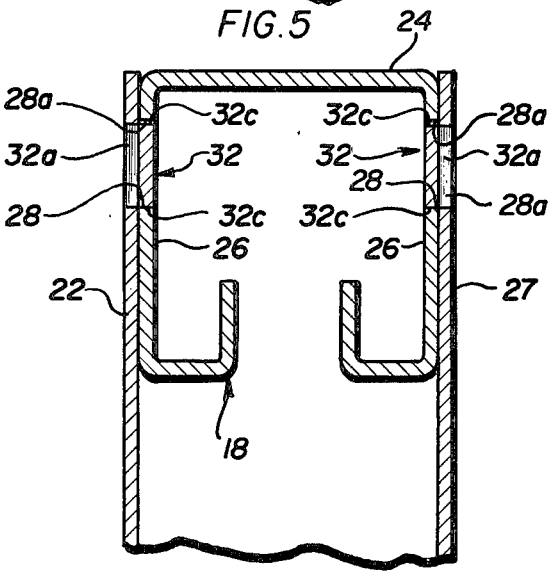
FIG. 5 is a partial sectional view taken generally along the line 5—5 of FIG. 4.

Discussion will now be had with regard to the joint of the present invention, while referring to FIGS. 3, 4 and 5, wherein the interfitting portions of a typical cross channel member 18 and upright channel member 16 are shown enlarged over FIGS. 1 and 2 to illustrate the additional details of the joint of the present invention. In this regard, the side flanges 26 each have an elongate through slot 28 formed therein. The slots 28 preferably are rectangular in form and symmetrically with respect to the two spaced side flanges 26. As such, each slot 28 includes a pair of spaced, generally horizontal edges **28*a*, and a leading vertical edge 28*b*. The side flanges 22 of upright channel 16 each include a pair of projections or detent members, designated generally 30 and 32, respectively. These detents 30 and 32 are formed by a stamping or striking operation, such that the material of the flanges 22** is deformed to provide the detents, but said material is only partially severed during the formation procedure.

With respect to the detents 30, it will be seen that they are substantially identical and symmetrically located with respect to their associated side flanges 22. Each detent 30 comprises a pair of generally congruent and oppositely disposed triangular segments **30*a* and 30*b* formed as a result of the stamping operation performed on the side flanges 22. The segments 30*a* and 30*b* generally slope in a direction away from the web 20 of channel member 16 and merge with the flanges 22. As a further result of said stamping operation, the material of flange 22 is severed or sheared, to provide each detent 30 with a severed, abrupt edge 30*c*, FIG. 4, which edge faces the web 20**.

Referring now to the detents 32, it will be seen that each said detent comprises a pair of generally congruent and oppositely disposed segments **32*a* and 32*b*. These segments 32*a* and 32*b* may be conveniently formed by stamping or other similar process to displace material of the respective side flanges 22. During the stamping of the detents 32, the material of the flange 22 is sheared or severed. As best seen in FIG. 3, the severing of the material of flange 22 enables the detent 32 to project from said flange, and also serves to define a pair of spaced, generally horizontal severed edge surfaces 32*c*. The vertical edge portions of the detent 32 remain integral with the flange 22. Accordingly, as can be seen, the segments 32*a* and 32*b* generally slope or flare in opposite directions to merge with the flange 22. Specifically, the tab portion 32*a* slopes outwardly in the direction of the web 20 while tab portion 32*b* flares outwardly in the direction away from the web 20**.

Before considering the operation of the joint of the present invention, there are a number of dimensional relationships which are of importance. More specifically, it should be noted that the vertical dimension or height of the detent 32, as indicated by arrows 33, is similar to, but slightly less than, the vertical dimension or width of the elongate slot 28, as indicated by arrows 35. Further, it should be noted that the length of elongate slots 28 is somewhat greater than the overall horizontal dimension defined along the side flanges 22 by the detents 30 and 32. That is to say, that the elongate slot 28 can accommodate or receive therein both detents 30 and 32. Moreover, the spacing of the leading vertical edge **28*b* of the slot 28 from the end face 36 of cross channel 18 is indicated by arrows 34, which spacing 34 is selected to be slightly less than the spacing 35 of the severed edge 30*c* of detent 30 from end face of web 20. As such, the end face 36 will be disposed in close proximity to the web 20, once the channel member 18 has been assembled to the channel member 16**.

In operation, the assembler or installer need only initially position the respective channels 16 and 18 as illustrated in FIG. 2 substantially aligning the respective slots 28 for engagement with the cooperating detents 30 and 32. Thereupon the installer may readily effect assembly by tapping or otherwise urging the upright channel members 16 into surrounding engagement with end portions of the cross channel members 18, until the detents 30 and 32 are engaged in the respective slots 28. As the channel members are urged into engagement, the detents 30 resiliently deform initially to allow passage of the leading edge of the cross channel 18 and thereafter snap into engagement with slot 28. Specifically, it will be seen that the inner or severed edge **30*c* of the detent 30 engages the leading vertical edge 28*b* of the slot 28, to substantially prevent removal or lateral displacement of cross channel 18. Accordingly, the tabs 30 and slots 28 define cooperating means on the respective channels for preventing lateral disengagement or disassembly thereof once assembled. The detents 32 are also somewhat resilient, such that upon assembly, the leading edge of channel 18 can pass thereover as said edge is received within channel member 16. The detents 32 will be received within the slots 28, and upon proper alignment will snap in place. It will be recalled that the height 33 of the detents 32 approximates, but is slightly less than the vertical width of slot 28. As such, once detents 32 and slots 28 are engaged, the severed edges 32*c* of said detents will confront and abut the horizontal edges 28*a* of said slot. This engagement serves substantially to preclude any relative pivotal movement of the cross channel 18 with respect to the upright channel 16. While a difference in the dimensions 33 and 35 is essential to permit the detent 32 to be engaged in slot 28**, this difference can be controlled so that the degree of relative movement permitted is insignificant.

As an additional matter, by controlling the dimensions 34 and 35, viz., the spacing between the slot 28 and edge 36, and the spacing of severed edge **30*c* from web 20, upon assembly, the end face 36 will be in close proximity, and preferably in abutting engagement with web 20, as the severed edges 30*c* engaged in the slots 28. While this abutting contact further serves to preclude relative pivotal movement, it is not essential since the severed edges 32*c* of the detent 32** engaging the edges 28*a* are the primary means for precluding such movement.

Thus, it can be appreciated that as the end of the cross channel 18 is engaged in the channel 16, the detents 30 and 32 will engage in slot 28 to provide a snap-type joint. The detent 30, and more specifically its severed edge 30*c* engage the vertical edge 28*b* of said slot to preclude lateral separation of the channel 18. Correspondingly, the detent 32, and specifically its spaced severed edges 32*c* abut the horizontal edges 28*a* of the slot to prevent relative pivotal movement. Accordingly, not only are the respective channel members maintained in assembly, but a squared relation is provided.

As is believed clear, the snap fit type joint provided by the present invention does not require that the frame be flipped over to complete assembly, as was true of the prior art arrangement. Moreover, as the frame structure 12 is substantially symmetrical, the panels or sheets 14 of siding may be immediately attached to the frame 12. The present invention therefore enables efficient and simple on-site fabrication of structural metal frames. The resulting frame and door is relatively strong and durable and highly reliable in service, the interlocking or interfitting tabs and slots substantially precluding loosening thereof or any tendency of the frame to go out of square while in service. Moreover, no special tools or expertise are required to assemble the frame 12, and the fabrication of the parts thereof is relatively simple and inexpensive.

While the present invention has been illustrated and described with reference to a specific embodiment, it is not intended that the invention be limited thereto. Various changes, modifications or alternatives will be apparent to those skilled in the art, once possessed with the present disclosure; for example, the location of the detents 30 and 32, and the slot 28 may be revised, or a separate slot means may be provided for each such detent. Accordingly, it is intended that the present invention include such changes, modifications or alternatives as fall within the spirit and scope of the claims appended hereto.

The invention is claimed as follows:

1. A door frame comprising; at least a pair of parallel, spaced apart upright channel members, and at least a pair of parallel spaced apart cross channel members assembled to said upright channel members and disposed generally perpendicular with respect to said upright channel members, said upright channel members and said cross channel members each include a web portion and two parallel side flanges, first interengagable cooperating means on said upright channel members and said cross channel members, which when engaged hold edge portions of said cross channel members in assembled relation with said upright channel members so as to substantially prevent disassembly, and second interengagable cooperating means on said upright channel members and said cross channel members which when engaged substantially prevent pivotal movement therebetween so as to maintain the assembled cross channel members and upright channel members in a substantially square relation and said first cooperating means comprises a detent member struck from each of the parallel side flanges of one of said channel members and projecting out of the plane of said flanges, and slot means formed in each of the parallel said flanges of the other of said channel members, and disposed for engagement of said detent members therein upon assembly of said cross channel members with said upright channel members, wherein said cross channel members edge portions are insertable between the parallel side flanges of said upright channel members, and said detent members are resilient for yielding to said insertion, and thereafter snappingly engaging said resilient detent member in said slot means, effecting assembly without the need for manual deformation.

2. A door frame according to claim 1 wherein said second cooperating means includes second detent means adjacent said first mentioned detent means and also extending out of the plane of said parallel said flanges, said second detent means also being resilient for yielding upon said assembly of said cross channel members and said upright channel members and thereafter for snappingly engaging in said slot means, said second detent means including spaced apart, horizontal edge portions, with the spacing therebetween being slightly less than the spacing between the corresponding horizontal edges of said slot such that said second detent means will be received in said slot with the respective horizontal edge portions disposed for abutting contact, which contact precludes relative pivotal movement between said channel member and serves to maintain said squared relation.

3. A door frame according to claim 1 wherein, said detent member includes a severed edge portion, such that upon disposition of said detent member in said slot means, said severed edge portion will confront and abut said vertical edge of said slot to maintain said channel member in assembly.

4. A door frame according to claim 1, wherein said slot means includes at least one generally vertical edge and a pair of generally horizontal edges, and said detent member, including a vertical, severed edge, and said second interengagable means including a second detent member struck from the same flange portion and including at least a pair of generally horizontal severed edges, such that said detent means may be engaged with said slot means with the severed edge of said first detent member confronting and abutting the vertical edge of said slot to preclude separation of the engaged channels, and the spaced severed generally horizontal edges of said detent confronting and abutting the corresponding edges of said slot to prevent relative rotational movement between said channel members, said detent and slot means serving to maintain said squared engagement.

5. A door frame according to claim 4 wherein said slot means for said first and second interengagable means includes a single slot which receives both said first and second detents.

6. A door frame according to claim 4, wherein interengagable slot and detent means are provided with respect to each pair of adjacent flange portions on the respective channel members.

7. A door frame according to claim 4 wherein said cross channel members have their respective end portions disposed within the channels provided by said upright channel members.

8. A door frame according to claim 7, wherein said detent means are formed in said upright channel members and said slot means formed in said cross channel members.

9. A door frame comprising, a pair of parallel spaced upright channel members, and at least a pair of parallel spaced apart cross channel members, said upright and cross channel members each including a web portion and a pair of spaced flange portions, which cooperate to define a channel like construction, and said upright and cross channel members being interengagable to provide a frame by the disposition of the end portions of one of said pair of channel members within the channels provided by the other of said pair, and engagement means provided to maintain said upright and cross channel members in squared, assembled relation, said engagement means including first interengagable detent means on the respective channel members for preventing lateral separation of said channel members, and second interenagable detent means for preventing relative rotational movement of the channel members, said second detent means comprising slot means formed in at least one flange portion of a first one of said channel members, a detent member struck from the adjacent flange portion of the other of said channel members, said detent member being received in said slot means and including severed edges which confront and abut the corresponding edges of said slot thereby to preclude said rotational movement.

10. A frame according to claim 9, wherein said first interengagable detent means includes a second detent member struck from the same flange portion as said first mentioned detent member, said second detent member including a severed edge, and said slot means including a corresponding vertical edge portion, said second detent member being received in said slot means with said severed edge disposed in confronting abutting engagement with said slot means vertical edge portion to prevent lateral displacement of said channel members.

11. A door frame according to claim 9, wherein said first and second detent means are provided for each pair of adjacent flange portions.

12. A door frame according to claim 9, wherein said detent member of said second detent means, includes a pair of integral edge portions disposed transverse to said severed edge portion, and said detent being provided by a pair of generally planar surface segments extending at an angle with respect to said flange portion.

* * * * *

UNITED STATES PATENT AND TRADEMARK OFFICE

CERTIFICATE OF CORRECTION

PATENT NO. : 4,193,245

DATED : March 18, 1980

INVENTOR(S) : LARRY K. JOHNSON

It is certified that error appears in the above-identified patent and that said Letters Patent are hereby corrected as shown below:

Column 5, line 66, change "said" to --side--;

Column 6, line 12, change "said" to --side--;

Column 7, line 14, change "interenagable" to --interengagable--

Signed and Sealed this

*Tenth* Day of *June 1980*

[SEAL]

*Attest:*

SIDNEY A. DIAMOND

*Attesting Officer*

*Commissioner of Patents and Trademarks*